US011299957B2

(12) United States Patent
Rosten et al.

(10) Patent No.: US 11,299,957 B2
(45) Date of Patent: Apr. 12, 2022

(54) PLUG FOR A COILED TUBING STRING

(71) Applicant: AVALON RESEARCH LTD., Grande Prairie (CA)

(72) Inventors: Trevor Rosten, Grande Prairie (CA); Douglas Rosten, Grande Prairie (CA); Derek Kitchen, Elmworth (CA)

(73) Assignee: AVALON RESEARCH LTD., Grande Prairie (CA)

( * ) Notice: Subject to any disclaimer, the term of this patent is extended or adjusted under 35 U.S.C. 154(b) by 21 days.

(21) Appl. No.: 16/557,799

(22) Filed: Aug. 30, 2019

(65) Prior Publication Data

US 2020/0072017 A1 Mar. 5, 2020

Related U.S. Application Data

(60) Provisional application No. 62/725,127, filed on Aug. 30, 2018.

(51) Int. Cl.

| | |
|---|---|
| ***E21B 33/128*** | (2006.01) |
| ***E21B 33/129*** | (2006.01) |
| ***E21B 33/12*** | (2006.01) |

(52) U.S. Cl.

CPC ..... *E21B 33/128* (2013.01); *E21B 33/1216* (2013.01); *E21B 33/1293* (2013.01)

(58) Field of Classification Search

CPC . E21B 33/1216; E21B 33/128; E21B 33/1293
See application file for complete search history.

(56) References Cited

U.S. PATENT DOCUMENTS

| | | | | |
|---|---|---|---|---|
| 3,215,205 A | | 11/1965 | Sizer | |
| 3,364,997 A | * | 1/1968 | Current | E21B 33/1293 166/134 |
| 3,374,840 A | * | 3/1968 | Current | E21B 33/1293 166/134 |
| 3,412,803 A | * | 11/1968 | Stachowiak | E21B 33/1293 166/134 |
| 3,517,742 A | * | 6/1970 | Williams | E21B 33/1216 277/338 |
| 3,554,280 A | | 1/1971 | Tucker | |
| 3,559,733 A | | 2/1971 | Kilgore | |
| 3,666,010 A | | 5/1972 | Harris | |
| 4,121,657 A | | 10/1978 | McClure | |
| 4,151,875 A | | 5/1979 | Sullaway | |
| 4,627,496 A | | 12/1986 | Ashford et al. | |

(Continued)

FOREIGN PATENT DOCUMENTS

| | | | |
|---|---|---|---|
| CA | 2637304 C | | 8/2012 |
| CN | 107489397 A | * | 12/2017 |

(Continued)

*Primary Examiner* — Jennifer H Gay
(74) *Attorney, Agent, or Firm* — Finch & Maloney, PLLC; Michael Bujold; Jay Franklin

(57) ABSTRACT

A combination of a coiled tubing string, a tubing plug, and a setting tool is provided. The tubing plug has an inner mandrel with a movable, first stop toward a first end and a fixed second stop at a second end. As the first stop moves toward the second stop first and second seal ramps cause first and second elastomeric seals to seal against an inner surface of the coiled tubing string, and anchor ramps cause expandable anchors to expand and engage the inner surface of the coiled tubing string.

16 Claims, 7 Drawing Sheets

(56) References Cited

U.S. PATENT DOCUMENTS 4,765,404 A 8/1988 Bailey et al.
4,862,961 A 9/1989 Neff
5,131,468 A * 7/1992 Lane ..... E21B 33/122 166/120
5,429,194 A 7/1995 Nice
6,015,015 A 1/2000 Luft et al.
6,446,717 B1 9/2002 White et al.
6,772,844 B2 8/2004 Lloyd et al.
6,834,722 B2 12/2004 Vacik et al.
7,051,806 B2 5/2006 Dodd
7,124,831 B2 * 10/2006 Turley ..... E21B 33/1208 166/387
7,373,973 B2 5/2008 Smith et al.
7,387,170 B2 6/2008 Doane et al.
7,631,693 B2 12/2009 Tong et al.
7,708,080 B2 5/2010 Conaway et al.
7,762,323 B2 6/2010 Frazier
8,066,065 B2 * 11/2011 Buckner ..... E21B 33/1293 166/118
8,191,633 B2 * 6/2012 Frazier ..... E21B 34/063 166/317
8,205,671 B1 * 6/2012 Branton ..... E21B 33/1216 166/118
8,584,765 B2 * 11/2013 Slup ..... E21B 33/1293 166/382
8,950,476 B2 2/2015 Head
9,109,428 B2 * 8/2015 Frazier ..... E21B 34/063
9,359,863 B2 6/2016 Streich et al.
9,388,662 B2 * 7/2016 Frazier ..... E21B 29/002
9,470,058 B2 10/2016 Chen et al.
9,482,069 B2 11/2016 Powers
9,500,061 B2 * 11/2016 Frazier ..... E21B 33/1293
9,568,103 B2 2/2017 Gomez et al.
9,677,373 B2 * 6/2017 Harris ..... E21B 33/1216
10,408,011 B2 * 9/2019 Harris ..... E21B 33/1216
2004/0069485 A1 * 4/2004 Ringgengberg ..... E21B 33/134 166/187
2005/0061500 A1 3/2005 Dodd
2005/0189104 A1 * 9/2005 Turley ..... E21B 33/1208 166/134
2008/0073074 A1 * 3/2008 Frazier ..... E21B 33/1294 166/138
2009/0078407 A1 * 3/2009 Carro ..... E21B 33/129 166/187
2009/0090513 A1 4/2009 Bissonnette et al.
2010/0263857 A1 * 10/2010 Frazier ..... E21B 33/134 166/127
2011/0005779 A1 * 1/2011 Lembcke ..... E21B 33/1293 166/387
2011/0024134 A1 * 2/2011 Buckner ..... E21B 33/1204 166/382
2011/0061857 A1 * 3/2011 White ..... E21B 33/1216 166/196
2011/0277989 A1 * 11/2011 Frazier ..... E21B 34/063 166/193
2012/0055667 A1 3/2012 Ingram et al.
2012/0090847 A1 4/2012 Getzlaf et al.
2012/0193104 A1 8/2012 Hoffman et al.
2012/0234560 A1 * 9/2012 Ezell ..... E21B 23/01 166/382
2013/0048311 A1 * 2/2013 Slup ..... E21B 23/01 166/382
2013/0112398 A1 * 5/2013 White ..... E21B 33/1216 166/118
2013/0112412 A1 * 5/2013 Frazier ..... E21B 33/129 166/298
2013/0292119 A1 11/2013 Hilliard et al.
2014/0116684 A1 5/2014 Hueston et al.
2014/0190685 A1 * 7/2014 Frazier ..... E21B 33/1293 166/250.01
2014/0231066 A1 8/2014 McColpin et al.
2015/0259999 A1 9/2015 Gonzalez
2016/0123104 A1 * 5/2016 Harris ..... E21B 33/1216 166/373
2016/0138362 A1 * 5/2016 Dockweiler ..... E21B 33/1216 166/138
2016/0168943 A1 6/2016 Hare et al.
2017/0145784 A1 * 5/2017 Zhou ..... E21B 33/128
2017/0275963 A1 * 9/2017 Harris ..... E21B 33/1216
2018/0016863 A1 * 1/2018 Webster ..... E21B 33/1216
2018/0171749 A1 * 6/2018 Yue ..... E21B 33/1293
2018/0347306 A1 * 12/2018 Burckhard ..... E21B 33/1208
2019/0032445 A1 * 1/2019 Dempsey ..... E21B 33/1293
2019/0128089 A1 * 5/2019 Guerra ..... E21B 33/1216
2020/0072017 A1 * 3/2020 Rosten ..... E21B 17/20
2020/0217172 A1 * 7/2020 Branton ..... E21B 33/128
2021/0032955 A1 * 2/2021 Zakharia ..... E21B 33/127

FOREIGN PATENT DOCUMENTS

EP 0798445 A2 * 10/1997 ..... E21B 33/1293
EP 0892147 A2 1/1999
GB 2253871 A * 9/1992 ..... F16J 15/20
GB 2296520 A 7/1996
WO WO-03067016 A2 * 8/2003 ..... E21B 17/1014
WO 2007034242 A1 3/2007
WO WO-2015119602 A1 * 8/2015 ..... E21B 33/129
WO WO-2017091589 A1 * 6/2017 ..... E21B 33/1293
WO WO-2017099789 A1 * 6/2017 ..... E21B 33/1294
WO 2017177119 A1 10/2017

* cited by examiner

PLUG FOR A COILED TUBING STRING

TECHNICAL FIELD

This relates to a plug for a tubing string, and in particular, a plug for a coiled tubing string.

BACKGROUND

Tubing strings are often used to convey fluids at high pressure in downhole operations. In some cases, it may become necessary to seal the tubing string at a location along its length. To seal the tubing string, tubing plugs may be inserted into the string, lowered to the desired location, and activated from a collapsed state to a sealing state. U.S. Pat. No. 3,412,803 (Stachowiak) entitled "Well tool anchors" describes an example of a tubing plug. U.S. Pat. No. 7,631,693 (Tong et al.) entitled "Retrievable plug system and methods of use" describes an example of a plug system designed for use in coiled tubing.

SUMMARY

According to an aspect, there is provided, in combination, a coiled tubing string having an inner surface that comprises a longitudinal seam and a tubing plug for sealing the interior of the coiled tubing string, the tubing plug comprising an inner mandrel having a first end, a second end, and a longitudinal axis that extends between the first end and the second end, the inner mandrel having a setting tool connection at the first end, a first stop slidably mounted to the mandrel toward the first end, and a second stop fixedly mounted to the mandrel toward the second end, a seal ramp section carried by the inner mandrel, the seal ramp section comprising a first seal ramp that slopes inward and toward the first end of the inner mandrel, and a second seal ramp that slopes inward and toward the second end of the inner mandrel, a first elastomeric seal adjacent to the first seal ramp and a second elastomeric seal adjacent to the second seal ramp, the first elastomeric seal and the second elastomeric seal each having a first end facing toward the seal ramp section and a second end facing away from the seal ramp section, a first anchor ramp adjacent to the first elastomeric seal toward the first end of the inner mandrel, and a second anchor ramp adjacent to the second elastomeric seal toward the second end of the inner mandrel, and a first expandable anchor between the first stop and the first anchor ramp, and a second expandable anchor between the second stop and the second anchor ramp, wherein, as the first stop moves toward the second stop along the inner mandrel the first elastomeric seal and the second elastomeric seal move along the first seal ramp and the second seal ramp, respectively, such that the seal ramp section causes the first elastomeric seal and the second elastomeric seal to expand outward into sealing engagement with the inner surface of the coiled tubing string and the longitudinal seam of the inner surface, the first anchor ramp and the second anchor ramp cause the first expandable anchor and the second expandable anchor, respectively, to move out and engage the inner surface of the coiled tubing, and a setting tool for setting the tubing plug, the setting tool being connected to apply a force to move the first stop toward the second stop.

According to other aspects, the second end of each of the first elastomeric seal and the second elastomeric seal may be tapered, and the tubing plug may further comprises a first anti-extrusion assembly adjacent to the tapered end of the first elastomeric seal between the first elastomeric seal and the first anchor ramp, and a second anti-extrusion assembly adjacent to the tapered end of the second elastomeric seal between the second elastomeric seal and the second anchor ramp, the first anti-extrusion assembly and the second anti-extrusion assembly being movable relative to the inner mandrel, as the first stop moves toward the second stop along the inner mandrel, the tapered end of the first elastomeric seal and the tapered end of the second elastomeric seal may cause the first anti-extrusion assembly and the second anti-extrusion assembly, respectively, to expand outward toward the inner surface of the coiled tubing string, the first anti-extrusion assembly and the second anti-extrusion assembly forming a chamber that contains and prevents extrusion of the first elastomeric seal and the second elastomeric seal, the elastomer ramp section may comprise a central apex between the first seal ramp and the second seal ramp, the first anti-extrusion assembly and the second anti-extrusion assembly may each comprise overlapping petalloid extensions, the first anti-extrusion assembly and the second anti-extrusion assembly may each further comprise an elastomeric support positioned between the overlapping petalloid extensions and the first elastomeric seal and the second elastomeric seal, and the elastomeric support may have a hardness greater than the first elastomeric seal and the second elastomeric seal, and an outer surface of the inner mandrel may further comprise a ratcheting surface and the first stop comprises a ratchet engagement profile that permits movement of the first stop toward the second stop and prevents movement of the first stop away from the second stop.

According to an aspect, there is provided a method of sealing a coiled tubing string comprising a longitudinal seam, the method comprising the steps of providing a tubing plug for sealing the interior of the coiled tubing string, the tubing plug comprising an inner mandrel having a first end, a second end, and a longitudinal axis that extends between the first end and the second end, the inner mandrel having a setting tool connection at the first end, a first stop slidably mounted to the mandrel toward the first end, and a second stop fixedly mounted to the mandrel toward the second end, a seal ramp section carried by the inner mandrel, the seal ramp section comprising a first seal ramp that slopes inward and toward the first end of the inner mandrel, and a second seal ramp that slopes inward and toward the second end of the inner mandrel, a first elastomeric seal adjacent to the first seal ramp and a second elastomeric seal adjacent to the second seal ramp, the first elastomeric seal and the second elastomeric seal having a first end facing toward the seal ramp section and a second end facing away from the seal ramp section, a first anchor ramp adjacent to the first elastomeric seal toward the first end of the inner mandrel, and a second anchor ramp adjacent to the second elastomeric seal toward the second end of the inner mandrel, and a first expandable anchor between the first stop and the first anchor ramp, and a second expandable anchor between the second stop and the second anchor ramp, positioning the tubing plug at a location to be sealed within the coiled tubing string, and applying a force to move the first stop toward the second stop such that: the first elastomeric seal and the second elastomeric seal move along the first seal ramp and the second seal ramp, respectively, such that the seal ramp section causes the first elastomeric seal and the second elastomeric seal to expand outward into sealing engagement with the inner surface of the coiled tubing string and the longitudinal seam of the inner surface, and the first anchor ramp and the second anchor ramp cause the first expandable anchor and the second expandable anchor, respectively, to move out and engage the inner surface of the coiled tubing.

According to other aspects, the second end of each of the first elastomeric seal and the second elastomeric seal may be tapered, and the tubing plug may further comprise a first anti-extrusion assembly adjacent to the tapered end of the first elastomeric seal between the first elastomeric seal and the first anchor ramp, and a second anti-extrusion assembly adjacent to the tapered end of the second elastomeric seal between the second elastomeric seal and the second anchor ramp, the first anti-extrusion assembly and the second anti-extrusion assembly being movable relative to the inner mandrel, wherein as the first stop moves toward the second stop along the inner mandrel, the tapered end of the first elastomeric seal and the tapered end of the second elastomeric seal may cause the first anti-extrusion assembly and the second anti-extrusion assembly, respectively, to expand outward toward the inner surface of the coiled tubing string, the first anti-extrusion assembly and the second anti-extrusion assembly forming a chamber that contains and prevents extrusion of the first elastomeric seal and the second elastomeric seal, the seal ramp section may comprise a central apex between the first seal ramp and the second seal ramp, the first anti-extrusion assembly and the second anti-extrusion assembly may each comprise overlapping petalloid extensions, the first anti-extrusion assembly and the second anti-extrusion assembly may each further comprise an elastomeric support positioned between the overlapping petalloid extensions and the first elastomeric seal and the second elastomeric seal, and the elastomeric support may have a hardness greater than the first elastomeric seal and the second elastomeric seal, and an outer surface of the inner mandrel may further comprise a ratcheting surface and the first stop comprises a ratchet engagement profile that permits movement of the first stop toward the second stop and prevents movement of the first stop away from the second stop.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 1:
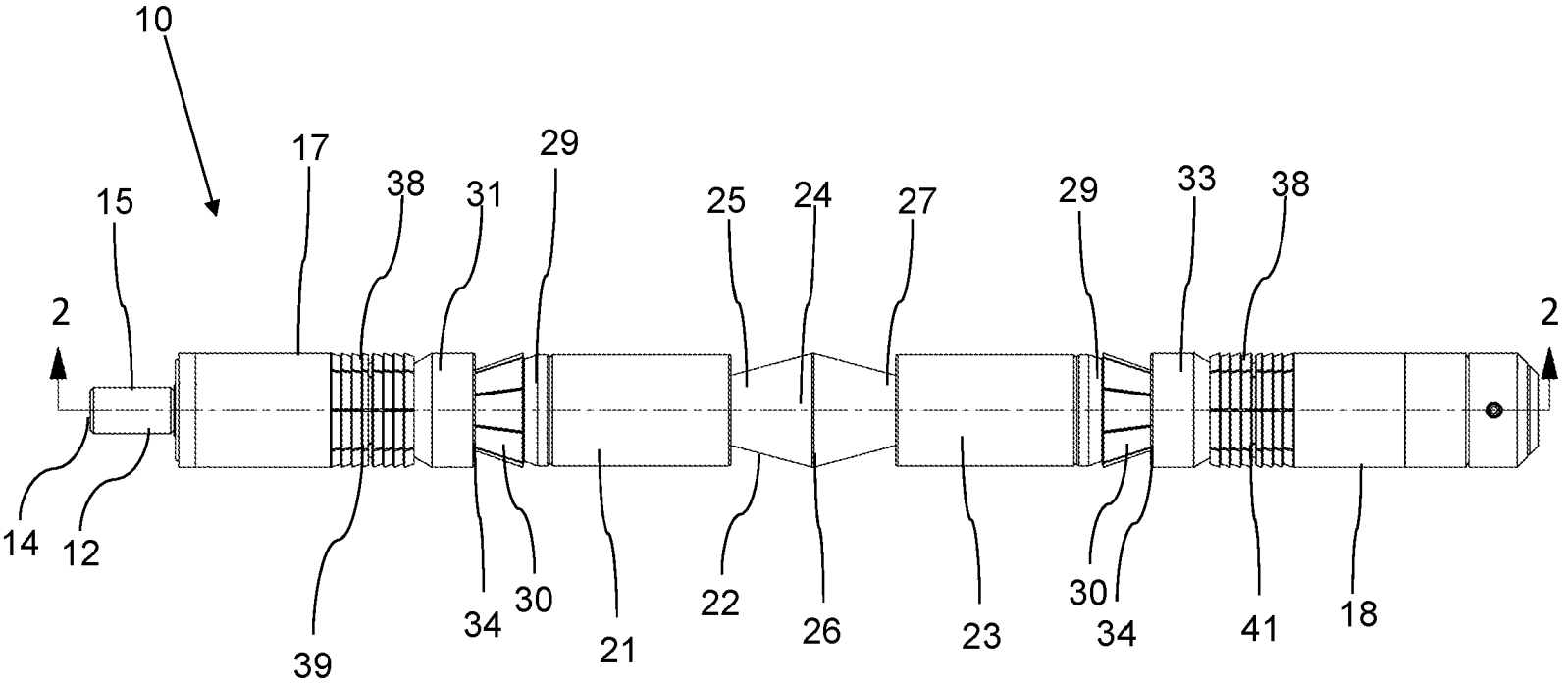
FIG. 1 is a side elevation view of a coiled tubing plug.

A tubing plug, generally identified by reference numeral 10, will now be described with reference to FIG. 1 through 7. Tubing plug 10 is designed to be inserted into a length of coiled tubing 50, where it is activated by a setting tool 70 to sealingly engage an inner surface 52 of coiled tubing 50. Coiled tubing 50 is generally used as a spoolable, continuous tubing string and therefore may be any length. Due to the way in which coiled tubing is manufactured, it generally has a longitudinal seam 54, shown in FIG. 5, which extends along the length of coiled tubing 50 and typically protrudes inward away from inner surface 52 of coiled tubing 50. Coiled tubing 50 is typically cylindrical with a diameter of between 1 and 3.25 inches, although it may be manufactured with other diameters, depending on the intended application. It will be understood that the relative dimensions of tubing plug 10 will be selected to correspond with those of coiled tubing 50. As will be described below, tubing plug 10 is designed to be generally cylindrical and to seal within coiled tubing 50 against inner surface 52 and longitudinal seam 54, as shown in FIG. 7, and to accommodate and seal against the uneven profile resulting from longitudinal seam 54.

Figure 2:
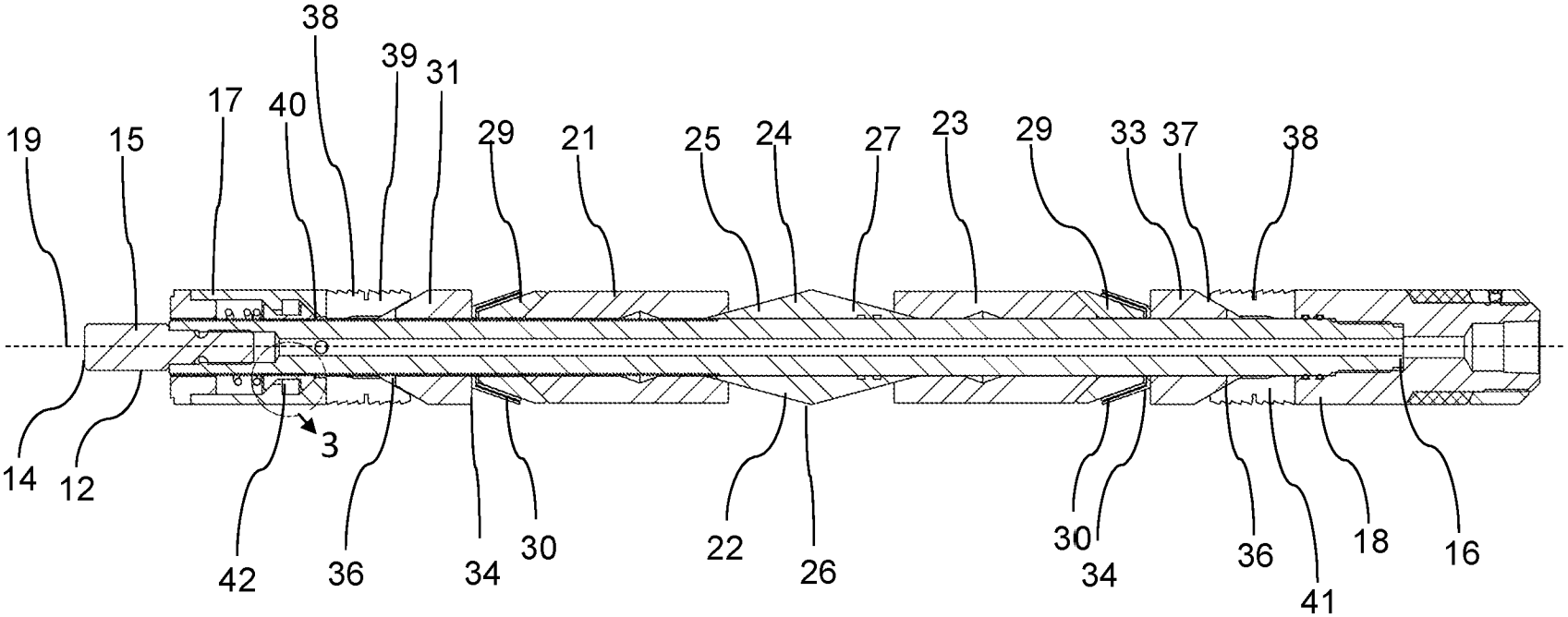
FIG. 2 is a side elevation view of a cross section of a coiled tubing plug, taken along line 2-2 in FIG. 1.

Referring to FIG. 2, tubing plug 10 is supported by an inner mandrel 12, which has a first end 14, a second end 16, and a longitudinal axis 19 that extends between first and second ends 14 and 16. Inner mandrel 12 has a setting tool connection 15 at a first end 14, and carries a first stop 17 and a second stop 18. Second stop 18 is fixedly mounted to inner mandrel 12 toward second end 16 of inner mandrel, while first stop 17 is slidably mounted to inner mandrel 12 toward first end 14 of inner mandrel 12. Second stop 18 may be machined as an integral part of mandrel 12 or it may be attached to mandrel 12 after being manufactured. Various sleeves are slidably mounted coaxially on mandrel 12 between first stop 17 and second stop 18. As will be described below, the sleeves each have specific characteristics and are used to set and seal plug 10 when activated.

As shown, setting tool connection 15 is a threaded, shearable component that allows setting tool 70 to set plug 10 by application of a setting force to first stop 17 relative to inner mandrel 12, and then disconnect from plug 10 upon application of a breakaway force that causes connection 15 to break away from the remainder of inner mandrel 12. Different types of connections may also be used as will be known in the art that allow setting tool 70 to set plug 10, and preferably, to disconnect thereafter for retrieval. This may be done using either longitudinal or rotational forces. The depicted example does not include the details of setting tool 70, as various designs are well known in the art that are capable of applying a differential force between setting tool connection 15 and first stop 17 to activate plug 10 to the sealed state. For example, setting tool 70 may have an outer sleeve that applies a force to first stop 17, while an inner connection point is secured to setting tool connection 15 to hold it in place as first stop 17 moves along longitudinal axis 19 toward second stop 18 to set tubing plug 10. It is common to accomplish this using hydraulics to apply a differential pressure that causes the sleeve to slide downward, however other designs may use other motive forces.

Figure 3:
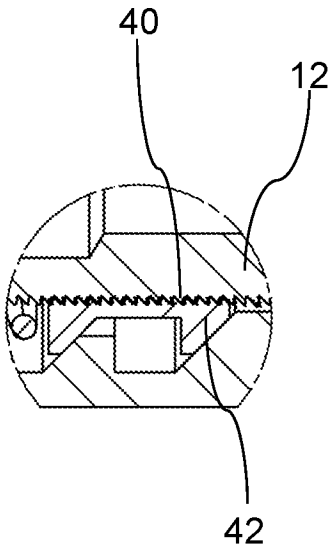
FIG. 3 is a detailed side elevation view in section of a ratchet nut and ratcheting surface, taken from circle 3 in FIG. 2.
Figure 4:
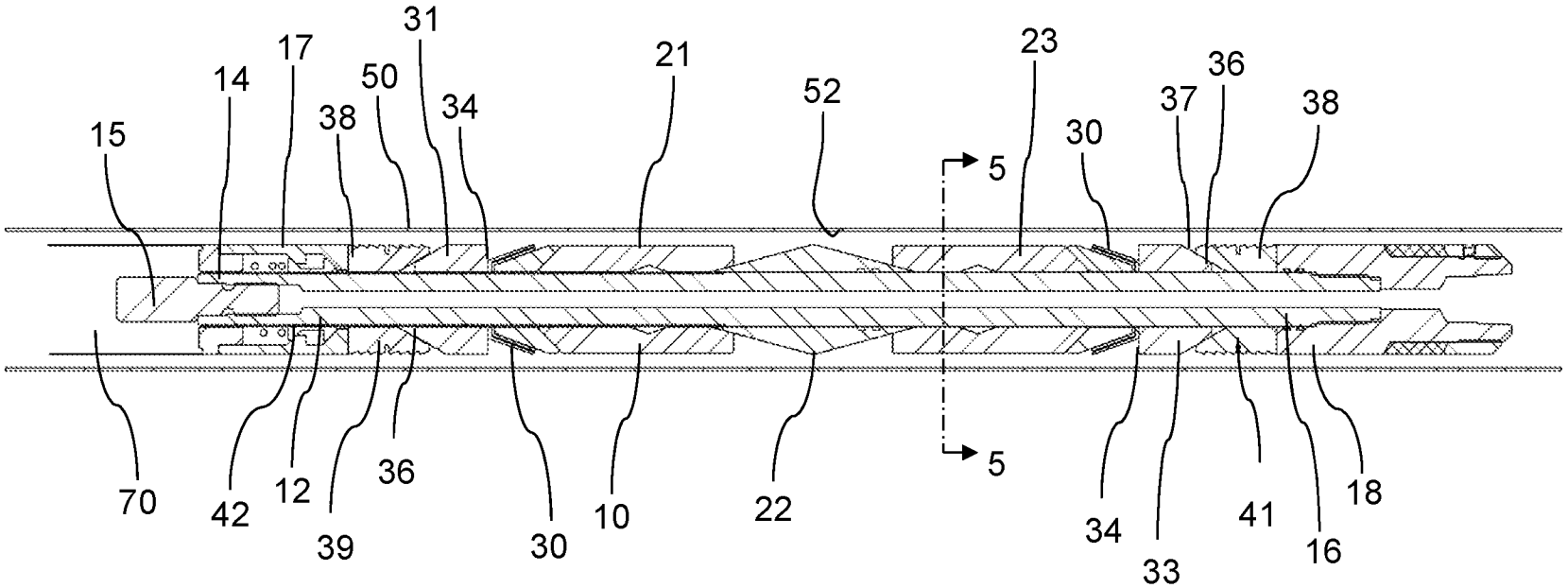
FIG. 4 is a side elevation view in cross section of a coiled tubing plug within a tubular.
Figure 5:
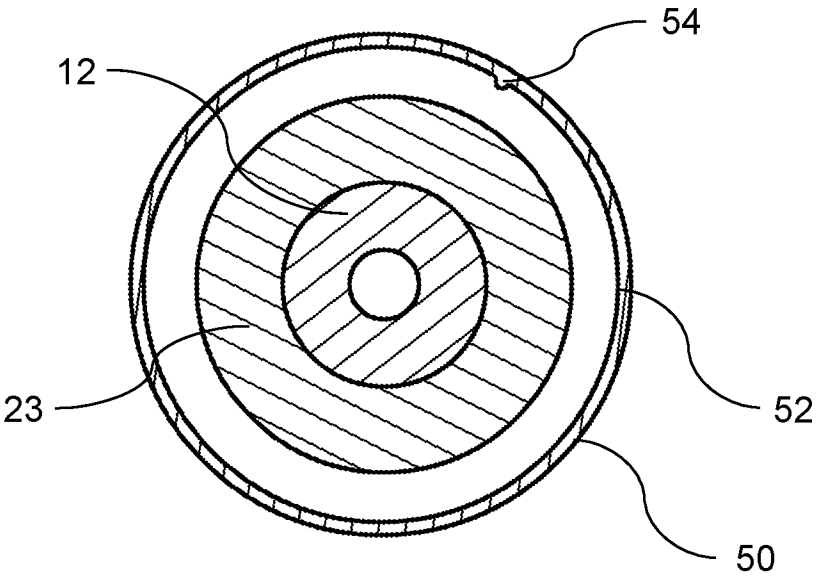
FIG. 5 is an end elevation view in section of a coiled tubing plug, taken along line 5-5 in FIG. 4.
Figure 6:
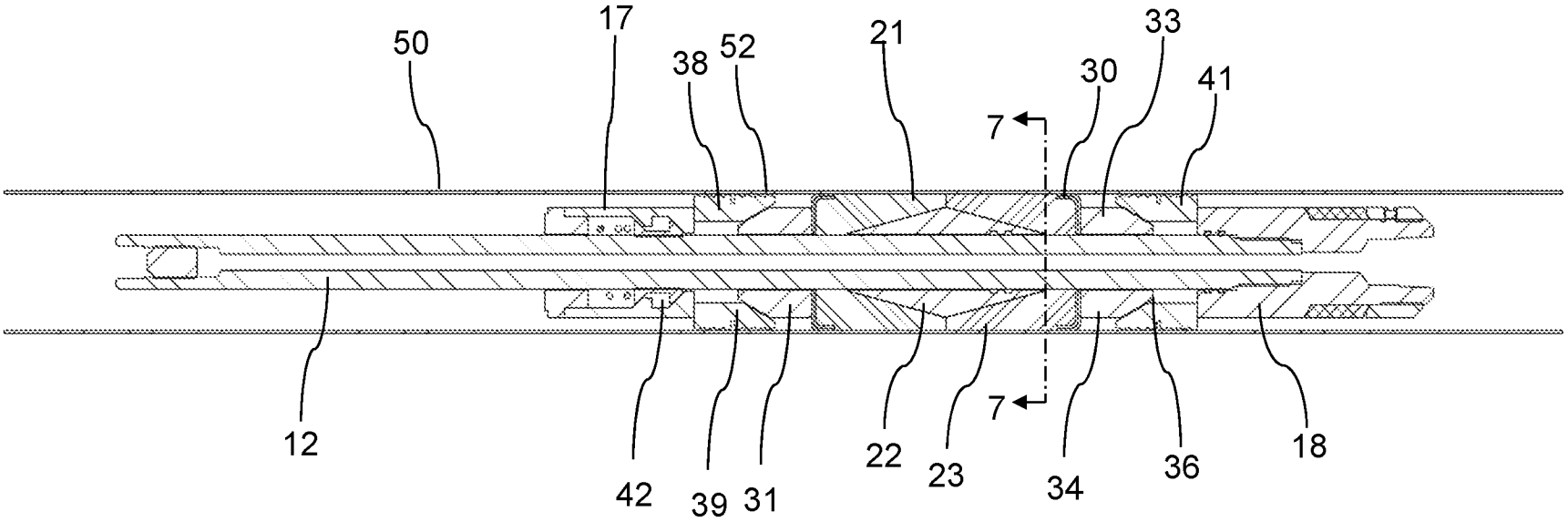
FIG. 6 is a side elevation view in cross section of the coiled tubing plug of FIG. 1 after being set in a tubular.
Figure 7:
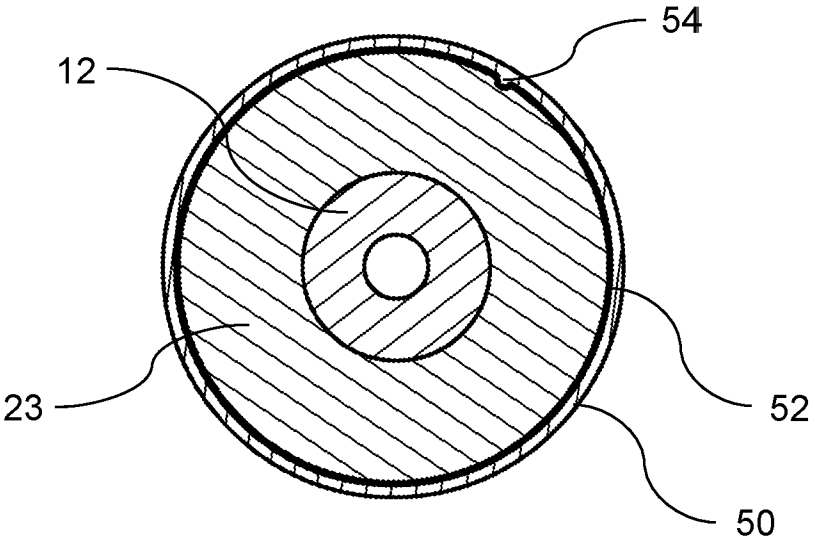
FIG. 7 is a cross section of a coiled tubing plug after being set in a tubular, taken along line 7-7 in FIG. 6.

Referring to FIGS. 4 and 6, first stop 17 includes a ratchet nut 42 that is used to hold first stop 17 in place after plug 10 is actuated. Referring to FIG. 3, ratchet nut 42 has an inner profile that engages a ratcheting surface 40 on mandrel 12 that allows movement toward second stop 19, while resisting movement in the opposite direction. Designs of suitable ratchets are known in the art and will not be described further.

Referring to FIG. 2, the slidable sleeves are symmetrically and slidably positioned along longitudinal axis 19 on either side of a seal ramp section 22. Seal ramp section 22 is a rigid sleeve that has a raised section 24 in its middle and two seal ramp sections 25 and 27 that taper down and away from the middle section. As shown, ramp sections 25 and 27 are in the form of two frusto-conical sections that meet at a central apex 26 with the circumference of the raised section continuously decreasing from apex 26 toward both first end 14 and second end 16 of inner mandrel 12, as depicted in FIG. 1. Elastomeric seals 21 and 23 are positioned axially above and below seal ramp sections 25 and 27, such that a first elastomeric seal 21 is adjacent to first seal ramp 25 and second elastomeric seal 23 is adjacent to second seal ramp 27. Elastomeric seals 21 and 23 are made of an elastomeric material capable of forming a sealing engagement between inner surface 52 and elastomer ramp section 22. Elastomeric seals 21 and 23 may be required to seal around longitudinal seam of inner surface 52, if present. When an activation force is applied and a compressive force applied to the slidable sleeves, first and second elastomeric seals 21 and 23 will slide along seal ramp sections 25 and 27, causing them to push outward and form a compressive seal between raised section 24 and inner surface 52 that is capable of withstanding pressures applied within coiled tubing string 50. It will be understood that each elastomeric seal 21 or 23 may be made as a single piece, or may be made from multiple distinct pieces of elastomeric material that make up elastomeric seals 21 and 23. Elastomeric seals 21 and 23 may, for example, be composite seals formed of elastomers of differing hardness in order to provide different sealing dynamics. This may allow a suitable seal to be manufactured that interacts differently, for example, with ramp sections 25 and 27, with inner surface 52 of coiled tubing string 50, and/or with anchor ramps 31 and 33 described below, or that has a different density and material characteristics within the core of elastomeric seals 21 and 23.

First and second anchor ramps 31 and 33 are provided opposite elastomeric seals 21 and 23 relative to seal ramp section 22. Anchor ramps 31 and 33 may have a first end 34 towards elastomeric seals 21 and 23, and a second end 36 opposite first end 34 towards first or second end 14 or 16 of mandrel 14, respectively, where first end 34 has a smaller diameter than second end 36. Anchor ramps 31 and 33 have a sloped surface 37 positioned between first end 34 and second end 36. Sloped surface 37 preferably has a slope that continuously decreases. Anchor ramps 31 and 33 may also include a flat portion adjacent to sloped surface 37, as shown.

First and second expandable anchors 39 and 41 are positioned adjacent and opposite to anchor ramps 31 and 33 relative to ramp section 22, such that first expandable anchor 39 is between first stop 17 and first anchor ramp 31, and second expandable anchor 41 is between second stop 18 and second anchor ramp 33. When tubing plug 10 is set, expandable anchors 39 and 41 move over top of anchor ramps 31 and 33, respectively, and expand outward to engage inner surface 52 of coil tubing 50. When engaged with inner surface 52, expandable anchors 39 and 41 have an outer profile that resists movement along longitudinal axis 19 such that tubing plug 10 is secured against lateral movement within coil tubing 50. As shown, expandable anchor 39 has an engagement profile that resists movement in the opposite direction of expandable anchor 41. FIG. 6 shows tubing plug 10 in its set state, with expandable anchors 39 and 41 and seals 21 and 23 engaged with coiled tubing 50. Referring to FIG. 7, where coiled tubing 50 has inner seam 54, elastomeric seals 21 and 23 deform around inner seam 54 of coiled tubing 50 to provide a fluid impermeable seal capable of withstanding high pressures in coiled tubing 50.

Referring to FIG. 6, anti-extrusion surfaces 30 may be positioned axially above and below elastomeric seals 21 and 23 to protect elastomeric seals 21 and 23 against extrusion that may occur with expandable anchors 39 and 41. When tubing plug 10 is set, anti-extrusion surfaces 30 engage the upper and lower edges of elastomeric seals 21 and 23, preventing the elastomeric material from extruding away from elastomer ramp section 22. Anti-extrusion surfaces 30 may include either a ring that engages elastomeric seals 21 and 23, petalloid extensions that engage elastomeric seals 21 and 23, or a combination of both a ring and petalloid extensions. In order to further reduce extrusion of elastomeric seals 21 and 23, there may also be two elastomeric supports 29 provided axially above and axially below seals 21 and 23, as shown in FIG. 4. As elastomeric supports 29 are more likely to be exposed to the high pressure fluid in coiled tubing 50, they may be formed from an elastic material that is resistant to extrusion, such as an elastomer that has a greater hardness than the elastomer that forms elastomeric seals 21 and 23. Seals 29 may be provided to act between anti-extrusion surfaces 30, where seals 29 are sufficiently stiff to resist extruding through or around anti-extrusion surfaces 30, but soft enough to expand and prevent seals 21 and 23 from extruding around seals 29. Anti-extrusion surface 30 and seal 29 may be used together to form an anti-extrusion assembly. After being set, elastomeric supports 29 may be compressed between inner seals 21 and 23 and anti-extrusion surfaces 30. Anchor ramps 31 and 33 may be positioned axially above, axially below, and adjacent to anti-extrusion surfaces 30 and engage anti-extrusion surfaces 30 when tubing plug 10 is set.

Referring to FIG. 3, in addition to connection 15, inner mandrel 12 has a locking mechanism that restrains first stop 17 once actuated. As shown, the locking mechanism is a ratcheting surface 40 near first end 14, adjacent to connection 15, and positioned between connection 15 and second end 16 that engages a ratchet nut 42. This allows first stop 17 to be locked into place at a location along ratcheting surface 40 to set tubing plug 10 and hold the various components in a compressed state along the axis of tubing plug 10, causing the components to expand outward.

Tubing plug 10 is set by setting tool 70, which may be threadably connected to tubing plug 10 at connection 15 of first end 14 of inner mandrel 12. Setting tool 70 may be run on a suitable elongate member that fits within coiled tubing 50, such as a tubing string, and allows an operator to position tubing plug 10 within coiled tubing 50 and set tubing plug 10. Setting tool 70 applies a force to first stop 17 of tubing plug 10 and compresses the slidable sleeves to set tubing plug 10. When setting tool 70 is activated, it will provide a force that compresses the slidable sleeves axially together between stops 17 and 18, such that expandable anchors 39 and 41 expand as they move along anchor ramps 31 and 33 to engage inner surface 52 of coiled tubing string 50. Anchor ramps 31 and 33 may engage anti-extrusion surfaces 30, if provided, and anti-extrusion surfaces 30 may engage seals 21 and 23, such that seals 21 and 23 overlie raised section 24 of elastomer ramp section 22 and sealingly engage inner surface 52. Seals 21 and 23 may also be directly engaged by anchor ramps 31 and 33. Anti-extrusion surfaces 30 may prevent seals 21 and 23 from extruding back toward anchor ramps 31 and 33. In the depicted example, the slidable sleeves are held in the deployed state by stop 18 at second end 16 and first stop 17 and ratchet nut 42 that is locked into place along ratcheting surface 40. FIG. 3 shows ratchet nut 42 and how it may be locked into place on ratcheting surface 40. The slidable sleeves may also be held in the compressed state by other types of locking mechanisms, as are known in the art.

The method for sealing coiled tubing 50 has the following steps: tubing plug 10, described above, is provided and has setting tool 70 connected to its first end 14. Tubing plug 10 is inserted into coiled tubing 50 and positioned at a location within coiled tubing 50 that is to be sealed, and setting tool 70 is activated, causing the plurality of slidable sleeves to be compressed together, as described above and depicted in FIG. 6. As first stop 17 is slidable and allows for compression of the slidable sleeves, while second stop 18 is fixed relative to inner mandrel 12, first and second stop 17 and 18 are moved closer together, which causes elastomeric seals 21 and 23 to move along seal ramp section 22, forcing them outwards towards inner surface 52. Expandable anchors 39 and 41 move along anchor ramps 31 and 33 and expand outwards towards inner surface 52. The compression of the slidable sleeves results in elastomeric seals 21 and 23 sealing the interior of coiled tubing 50, providing a high pressure tolerant, fluid impermeable seal that accommodates seam 54, as depicted in FIG. 7, while expandable anchors 39 and 41 are engage inner surface 52 of coiled tubing 50, and anchor tubing plug 10 in a fixed location. Expandable anchors 39 and 41 may, for example, have a plurality of ridges or teeth, as shown in FIG. 1, that are capable of engaging inner surface 52 sufficiently to prevent movement of tubing plug 10 in high pressure scenarios. For example, the ridges or teeth may bite into or deform the inner surface 52 sufficiently to provide an engagement surface that resists movement of tubing plug 10.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A tubing plug for sealing against an inner surface of a coiled tubing string, the tubing plug comprising:

an inner mandrel having a first end, a second end, and a longitudinal axis that extends between the first end and the second end, the inner mandrel having a setting tool connection at the first end;

a first stop slidably mounted to the mandrel, and a second stop fixedly mounted to the mandrel toward the second end relative to the first stop:

a seal ramp section carried by the inner mandrel, the seal ramp section comprising a first seal ramp that tapers toward the first end of the inner mandrel, and a second seal ramp that tapers toward the second end of the inner mandrel;

a first elastomeric seal adjacent to the first seal ramp and a second elastomeric seal adjacent to the second seal ramp, the first elastomeric seal and the second elastomeric seal each having a first end facing toward the seal ramp section and a second end facing away from the seal ramp section, and the first seal ramp and the second seal ramp being rigid relative to the first elastomeric seal and the second elastomeric seal;

a first anchor ramp adjacent to and opposite the first elastomeric seal relative to the seal ramp section, and a second anchor ramp adjacent to and opposite the second elastomeric seal relative to the seal ramp section; and a first expandable anchor between the first stop and the first anchor ramp, and a second expandable anchor between the second stop and the second anchor ramp;

wherein, as the first stop moves toward the second stop along the inner mandrel:

the first elastomeric seal and the second elastomeric seal slide along the first seal ramp and the second seal ramp, respectively, such that the seal ramp section causes the first elastomeric seal and the second elastomeric seal to expand outward into sealing engagement with the inner surface of the coiled tubing string; and the first anchor ramp and the second anchor ramp cause the first expandable anchor and the second expandable anchor, respectively, to move out and engage the inner surface of the coiled tubing.

2. The tubing plug of claim 1, wherein the second end of each of the first elastomeric seal and the second elastomeric seal are tapered, and the tubing plug further comprises a first anti-extrusion assembly adjacent to the tapered end of the first elastomeric seal, and a second anti-extrusion assembly adjacent to the tapered end of the second elastomeric seal, the first anti-extrusion assembly and the second anti-extrusion assembly being movable relative to the inner mandrel.

3. The tubing plug of claim 2, wherein as the first stop moves toward the second stop along the inner mandrel, the tapered end of the first elastomeric seal and the tapered end of the second elastomeric seal cause the first anti-extrusion assembly and the second anti-extrusion assembly, respectively, to expand outward toward the inner surface of the coiled tubing string, the first anti-extrusion assembly and the second anti-extrusion assembly forming a chamber that contains and prevents extrusion of the first elastomeric seal and the second elastomeric seal.

4. The tubing plug of claim 2, wherein the first anti-extrusion assembly and the second anti-extrusion assembly each comprise overlapping petalloid extensions.

5. The tubing plug of claim 4, wherein the first anti-extrusion assembly and the second anti-extrusion assembly each further comprise an elastomeric support positioned between the overlapping petalloid extensions and the first elastomeric seal and the second elastomeric seal, the elastomeric support having a hardness greater than the first elastomeric seal and the second elastomeric seal.

6. The tubing plug of claim 1, wherein the seal ramp section comprises a central apex between the first seal ramp and the second seal ramp.

7. The tubing plug of claim 1, wherein an outer surface of the inner mandrel comprises a ratcheting surface toward the first end, and the first stop comprises a ratchet engagement profile that engages the ratcheting surface, such that the ratchet engagement profile permits movement of the first stop toward the second stop and prevents movement of the first stop away from the second stop.

8. The tubing plug of claim 1, wherein the inner surface of the coiled tubing string comprises a longitudinal seam, and the first elastomeric seal and the second elastomeric seal expand outward into sealing engagement with the inner surface of the coiled tubing string and around the longitudinal seam.

9. A method of sealing a coiled tubing string, the method comprising the steps of:

providing a tubing plug for sealing the interior of the coiled tubing string, the tubing plug comprising:

an inner mandrel having a first end, a second end, and a longitudinal axis that extends between the first end and the second end, the inner mandrel having a setting tool connection at the first end;

a first stop slidably mounted to the mandrel, and a second stop fixedly mounted to the mandrel toward the second end relative to the first stop;

a seal ramp section carried by the inner mandrel, the seal ramp section comprising a first seal ramp that tapers toward the first end of the inner mandrel, and a second seal ramp that tapers toward the second end of the inner mandrel;

a first elastomeric seal adjacent to the first seal ramp and a second elastomeric seal adjacent to the second seal ramp, the first elastomeric seal and the second elastomeric seal having a first end facing toward the seal ramp section and a second end facing away from the seal ramp section, and the first seal ramp and the second seal ramp being rigid relative to the first elastomeric seal and the second elastomeric seal;

a first anchor ramp adjacent to and opposite the first elastomeric seal relative to the seal ramp section, and a second anchor ramp adjacent to and opposite the second elastomeric seal relative to the seal ramp section; and a first expandable anchor between the first stop and the first anchor ramp, and a second expandable anchor between the second stop and the second anchor ramp;

positioning the tubing plug at a location to be sealed within the coiled tubing string; and applying a force to move the first stop toward the second stop such that:

the first elastomeric seal and the second elastomeric seal slide along the first seal ramp and the second seal ramp, respectively, such that the seal ramp section causes the first elastomeric seal and the second elastomeric seal to expand outward into sealing engagement with the inner surface of the coiled tubing string; and the first anchor ramp and the second anchor ramp cause the first expandable anchor and the second expandable anchor, respectively, to move out and engage the inner surface of the coiled tubing.

10. The method of claim 9, wherein the seal ramp section comprises a central apex between the first seal ramp and the second seal ramp.

11. The method of claim 10, wherein as the first stop moves toward the second stop along the inner mandrel, the tapered end of the first elastomeric seal and the tapered end of the second elastomeric seal cause the first anti-extrusion assembly and the second anti-extrusion assembly, respectively, to expand outward toward the inner surface of the coiled tubing string, the first anti-extrusion assembly and the second anti-extrusion assembly forming a chamber that contains and prevents extrusion of the first elastomeric seal and the second elastomeric seal.

12. The method of claim 10, wherein the first anti-extrusion assembly and the second anti-extrusion assembly each comprise overlapping petalloid extensions.

13. The method of claim 12, wherein the first anti-extrusion assembly and the second anti-extrusion assembly each further comprise an elastomeric support positioned between the overlapping petalloid extensions and the first elastomeric seal and the second elastomeric seal, the elastomeric support having a hardness greater than the first elastomeric seal and the second elastomeric seal.

14. The method of claim 13, wherein an outer surface of the inner mandrel comprises a ratcheting surface toward the first end, and the first stop comprises a ratchet engagement profile that engages the ratcheting surface, such that the ratchet engagement profile permits movement of the first stop toward the second stop and prevents movement of the first stop away from the second stop.

15. The method of claim 9, wherein the second end of each of the first elastomeric seal and the second elastomeric seal are tapered, and the tubing plug further comprises a first anti-extrusion assembly adjacent to the tapered end of the first elastomeric seal between the first elastomeric seal and the first anchor ramp, and a second anti-extrusion assembly adjacent to the tapered end of the second elastomeric seal between the second elastomeric seal and the second anchor ramp, the first anti-extrusion assembly and the second anti-extrusion assembly being movable relative to the inner mandrel.

16. The method of claim 9, wherein the inner surface of the coiled tubing string comprises a longitudinal seam, and wherein the first elastomeric seal and the second elastomeric seal expand outward into sealing engagement with the inner surface of the coiled tubing string and around the longitudinal seam.

* * * * *